United States Patent [19]

Masuda

[11] 4,141,304

[45] Feb. 27, 1979

[54] AUTOMATIC SEWING MACHINE

[75] Inventor: Kohji Masuda, Sagamihara, Japan

[73] Assignee: Kayaba Industry Co., Ltd., Tokyo, Japan

[21] Appl. No.: 797,118

[22] Filed: May 16, 1977

[51] Int. Cl.[2] ..... D05B 27/06

[52] U.S. Cl. ..... 112/153; 112/205

[58] Field of Search ..... 112/153, 203, 205, 121.11, 112/121.12, 121.15, 2, 102

[56] References Cited

U.S. PATENT DOCUMENTS

| | | | |
|---|---|---|---|
| 3,752,097 | 8/1973 | Fuller et al. | 112/121.12 |
| 3,970,014 | 7/1976 | Chano | 112/203 X |
| 3,970,016 | 7/1976 | Yanikoski | 112/121.12 |
| 3,970,017 | 7/1976 | Babson et al. | 112/121.12 |
| 4,013,025 | 3/1977 | Marforio | 112/153 X |

FOREIGN PATENT DOCUMENTS

| | | | |
|---|---|---|---|
| 1567893 | 4/1969 | France | 112/205 |

*Primary Examiner*—Peter Nerbun

*Attorney, Agent, or Firm*—Wenderoth, Lind & Ponack

[57] ABSTRACT

An automatic sewing machine includes a device for advancing and sewing a workpiece having a plurality of edges contiguous to each other in angular relationship, a device for guiding the edges of the workpiece in succession while the workpiece is being sewn, and a device for turning the workpiece about the sewing point of the sewing machine after one edge of the workpiece has been sewn to align another edge of the workpiece contiguous to such one edge with the advancing direction of the work.

7 Claims, 8 Drawing Figures

AUTOMATIC SEWING MACHINE

BACKGROUND OF THE INVENTION

This invention relates to an automatic sewing machine and more particularly, to an automatic sewing machine for continuously sewing the edges of a work or workpiece having a plurality of edges contiguous to each other in angular relationship in succession.

In continuously sewing a work having a plurality of contiguous edges connected together in angular relationship to each other, such as a pair of trousers, after a first edge of the work has been sewn, in order to sew a second edge of the work, it is necessary to turn the work about the position of the sewing needle so as to align the second edge with the advancing or feed direction of the work.

One of the conventional methods for turning the work in the manner mentioned hereinabove has been illustrated in U.S. Pat. No. 3,425,369, for example. According to the prior art turning method, after a first edge of the work has been sewn, a vertically movable turning member is lowered down onto a portion of the work which hangs from the table to hold the work against the surface of the table, the turning member is turned with the work portion held against the table surface, and the work is turned about the position of the sewing needle on the table until a second edge of the work contiguous to the first edge thereof is detected by a detection means which is adapted to detect whether or not the second edge is aligned with the sewing or work advancing direction. However, in the conventional work turning method, since the turning member is designed to turn the work by a predetermined angle while holding the work in a predetermined position or constant distance from each of the work edges, there is the disadvantage that the turning member can not positively engage the work portion inwardly of a second edge of the work when the member turns to the work after a first edge of the work has been sewn. That is, generally, since a plurality of contiguous edges of a work are not in constant angular relationship or have varying angular relationship to each other, the turning member tends to engage the work in a position excessively inwardly of a particular edge of the work and in a position excessively outwardly of another edge of the same work, that is, it can not be assured that the turning member always engages the work in a predetermined constant distance from all the edges of the work. When the turning member engages the work in a position excessively inwardly of an edge of the work, the edge is caused to crease and thus, even if the creased edge can be aligned with the work sewing or feed direction, a satisfactory or proper sewing operation can not be performed at such an edge. On the other hand, when the turning member engages the work in a position excessively outwardly of a edge of the work with the contact face of the turning member maintained nonparallel to the surface of the table, the turning member can not positively hold the work edge and tends to desengage from the work while the work is being turned whereby the work edge can not be brought to the correct alignment with the work sewing or feed direction. In order to eliminate such disadvantages, it has been proposed to construct the turning member so as to have a sufficiently large size and cause its contact face to maintain a parallel relationship to the surface of the table. But even with such a turning member, there are still the disadvantages that a crease or creases develop in the edge of the work and the edge can not be positively held down.

Furthermore, in the prior art method mentioned hereinabove, in the waiting position of the turning member, if the turning member is positioned in a position insufficiently spaced from the table surface during a sewing cycle, the turning member is contacted by a crease or creases developed in the work edge, thereby impeding the sewing operation. And when the turning member is again moved to the work holding-down position positioned in a position insufficiently spaced from the table surface for the next work turning operation after one work turning operation, the turning member comes into contact with the crease or creases in the work edge to the degree that the sewing result will become unsatisfactory. For this reason, it is necessary that the turning member has to be positioned at an otherwise unnecessarily great distance from the table surface. This appreciably prolongs the time required for the work holding-down operation by the turning member and renders the construction of the turning member complicated.

SUMMARY OF THE INVENTION

Thus, the object of the present invention is to provide an automatic sewing machine which can effectively eliminate the disadvantages inherent in the prior art devices referred to hereinabove.

One principal object of the present invention is to provide an automatic sewing machine in which after an edge of a work has been sewn, the work can be positively and rapidly turned so as to direct another edge of the work which is contiguous to the sewn edge in angular relationship to the sewing position.

Another principal object of the present invention is to provide an automatic sewing machine which comprises a turning means which is simple in construction and easy to operate.

Another principal object of the present invention is to provide an automatic sewing machine in which during the turning of a work in the sewing operation, the work is firmly held in a predetermined position thereof so that the turning of the work can be positively performed without developing any crease or creases in the work.

In order to attain the above objects, in one embodiment of the present invention, the turning means is provided at the leading end of a rocker arm and has a pair of clamps which move relative to each other so as to grip and release one edge of the work. One of the clamps is provided with a detection means for detecting an edge of the work to be gripped by the clamps. During the sewing of one edge of the work, the above-mentioned detection means detects another edge of the work to be next sewn and contiguous to the first edge. After the first edge of the work has been sewn, the pair of clamps move relative to each other in one direction to grip the second edge of the work and then, the turning means turns the rocker arm by a predetermined angle to turn the work to thereby align the next edge of the work with the sewing direction, whereupon the clamps move relative to each other in the opposite direction to release the work therefrom.

The above and other objects and attendant advantages of the present invention will be more readily apparent to those skilled in the art from a reading of the following detailed description, taken in conjunction with the accompanying drawings which show one preferred embodiment of the invention for the purpose of illustration only, but not for limiting the scope of the invention in any way.

PREFERRED EMBODIMENT OF THE INVENTION

Figure 1:
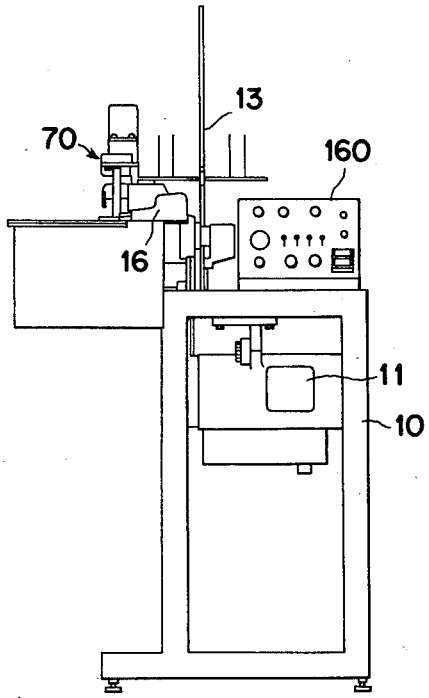
FIG. 1 is a front elevational view of one preferred embodiment of an automatic sewing machine constructed in accordance with the present invention.
Figure 2:
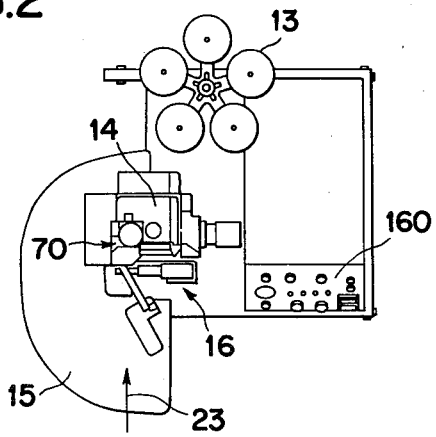
FIG. 2 is a plan view of the automatic sewing machine of FIG.1.
Figure 7:
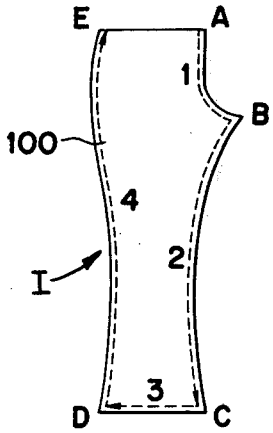
FIG. 7 is a plan view of the fabric piece for one of a pair of trousers to be sewn.
Figure 8:
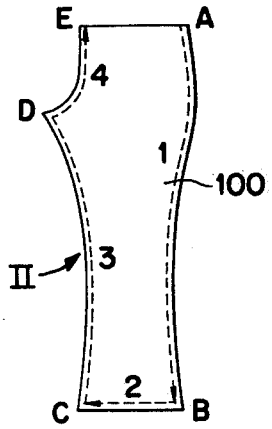
FIG. 8 is a plan view of the fabric piece for the other of the pair of trousers to be sewn.

The present invention will be now described referring to the accompanying drawings and more particularly, to FIGS. 1 and 2 thereof in which the automatic sewing machine of the present invention which is adapted to continuously sew the edges of a pair of trousers as articles to be sewn, as seen in FIGS. 7 and 8, is shown. The sewing machine generally comprises a framework 10, a main motor 11, a spool holder means 13 and a head 14. The framework 10 is provided with a table 15 on which the work 100 to be sewn is placed. The sewing machine also includes an automatic work guide means or manipulator 16 which cooperates with a conventional pressure bar (not shown) to regulate the positions of the edges of the work to be sewn to desired or proper positions and guide the work so that the work can be always sewn in predetermined or desired areas by the sewing needle (not shown) which extends from the head 14. The automatic work guide means may be the same construction as shown in U.S. Pat. application Ser. No. 772,340 filed in the name of the same applicant, for example. That is, the guide means comprises a stopper member 18 mounted on the table 15 and adapted to mechanically restrain the displacement of a particular edge of the work to be sewn in the inward direction from a proper position or a control position, as shown by the direction of arrow 17 in FIG. 3 (in the direction in which the distance from the particular edge to the sewing line increases), a detection means 20 adapted to detect the displacement of the particular edge of the work now being sewn in the reverse direction or in the outward direction from the control position, and a work feed control means 21 adapted to move the particular edge of the work in the inward direction in response to signals from the detection means 20 until the particular work edge reaches its predetermined proper position.

Figure 3:
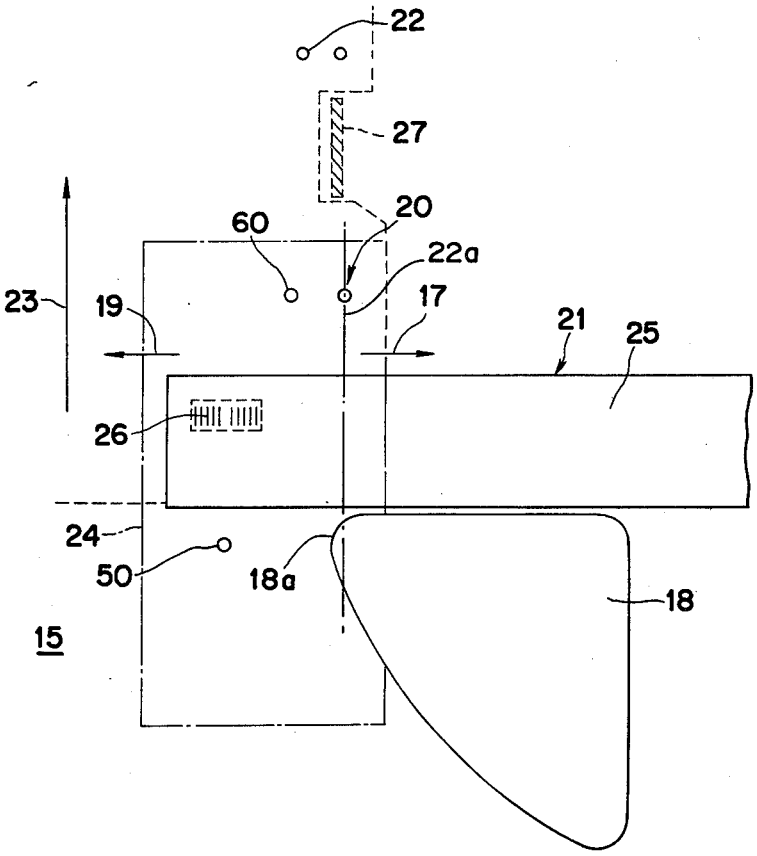
FIG. 3 is a fragmentary plan view on an enlarged scale of the detection means of the automatic sewing machine.

The stopper member 18 is positioned in the position in which the work contacting portion **18*a* of the stopper member is slightly positioned inwardly of the properly positioned edge 22*a* of the work to be sewn by a small distance upstream of the sewing needle drop point 22, in the work feed direction of arrow 23 (FIG. 3). As schematically shown in FIG. 3, the detection means 20 has a reflective plate 24 mounted on the table 15 and a luminous diode and a phototransistor (not shown) positioned above and spaced from the reflective plate for receiving the work therebetween. The detection means 20 is positioned inwardly of the needle drop point 22 and the work contacting portion 18*a* of the stopper member 18 with respect to the particular edge of the work. The output light from the luminous diode is reflected by the reflective plate 24 to be received by the phototransistor. Thus, the presence of the work on the reflective plate 24 or not is converted into an electric detection signal representative of a difference in the input lights of the phototransistor. The feed control means 21 comprises an arm 25, a control roller 26 provided at one end of the arm 25, a motor (not shown) for driving the control roller 26 and a cylinder (not shown) for driving the arm 25 so as to cause the control roller 26 to be urge against the work. Thus, the control roller 26 of the feed control means 21 is allowed to engage the work on the table in response to the operation of the cylinder. With the control roller 26 engaging the work, when the detection means 20 detects the absence of the work on the table, the detection signal from the detection means 20 drives the motor which in turn rotates the control roller 26 in the direction in which the work is pulled to be positioned below the detection means 20. When the work is positioned below the detection means 20 and the detection means 20 detects the presence of the work and provides a signal indicating the presence of the work, the motor is braked. With the motor maintained in its braked condition, the particular edge of the work to be sewn abuts against the stopper member 18 and is detered from being pulled towards the edge opposite to the particular edge of the same work. In this way, the work or the side edges of the work to be sewn are guided in the work feed direction 23, since the work positioned on the table is always adjusted to a proper position. In FIG. 3, reference numeral 27** denotes a trimming cutter.

As shown in FIG. 3, detection means 50 and 60 similar to the detection means 20 are disposed in opposition to the reflective plate 24. The detection means 50 provides a speed reduction signal to the main motor 11 while the work is being held in its stationary position and the portion thereof having a great curvature is being sewn and the detection means 60 provides an operation command signal to a thread cutter (not shown) while the work is being held in its stationary position. The detection means 60 is aligned with the detection means 20 in the work feed direction, and the detection means 50 is disposed at a substantial distance upstream of the detection means 60 in the work feed direction.

Figure 4:
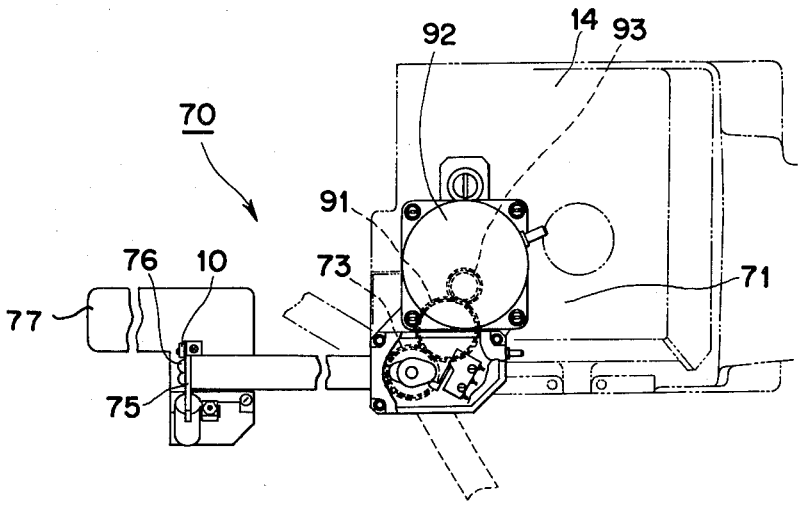
FIG. 4 is a fragmentary plan view on an enlarged scale of one embodiment of turning means suitably employed in the automatic sewing machine.
Figure 5:
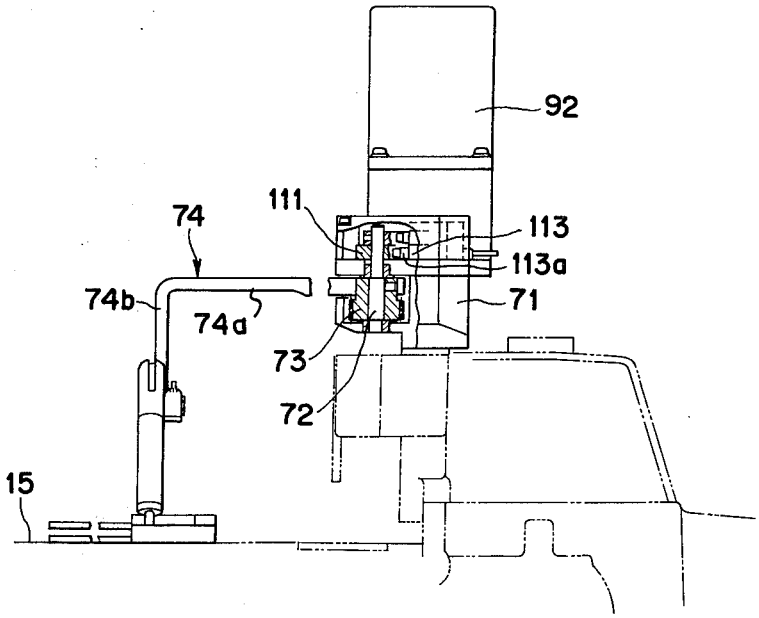
FIG. 5 is an elevational view of FIG. 4.
Figure 6:
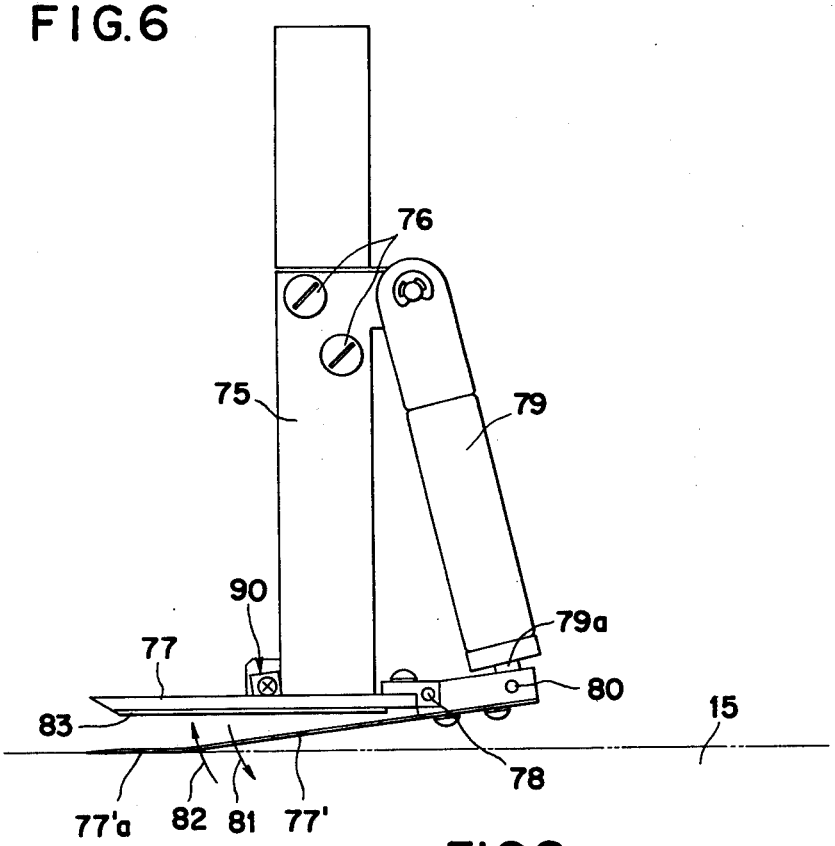
FIG. 6 is a side elevational view on a further enlarged scale of the clamps of the turning means shown in FIG. 4.

As is clear from the foregoing, a particular edge of the work in the form of one of a pair of trousers is guided and sewn in the proper sewing direction. Referring now to FIGS. 4 through 6 in which one embodiment of turning means 70 is shown the turning means is adapted to turn the work so that after the particular or first work edge has been sewn, the next edge or edge contiguous to the first work edge may be aligned with the sewing or work feed direction. In this embodiment, the turning means 70 includes a housing 71 fixedly mounted on the machine head 14 in which a vertically extending turning shaft 72 is journalled. Secured to the lower end of the turning shaft 72 is a gear 73 to which one end of a rocker arm 74 is secured. The rocker arm 74 comprises a horizontal portion 74*a* extending horizontally from the end secured to the gear through and out of the housing 71 and a vertical portion 74*b* extending vertically and downwardly from the horizontal portion 74*a* towards the table 15. The lower end of the vertical portion 74*b* has the upper end of an elongated rectangular mounting plate 75 secured thereto by means of a plurality of screws 76 (FIG. 6). The lower end of the mounting plate 75 has a pair of relatively movable clamps 77, 77′ attached thereto. As more clearly shown in FIG. 4, the clamps 77, 77′ are substantially L-shaped as seen in plan. Referring to FIG. 6, the upper clamp 77 is a stationary clamp secured to the mounting plate 75 and extending horizontally, whereas the lower clamp 77′ is a movable clamp pivoted at the rear end portion thereof to the adjacent end of the clamp 77 by means of a pivot pin 78. The extreme rear end of the pivotal clamp 77′ pivotally supports the lower end of the piston rod 79*a* of a cylinder 79 by means of a pivot pin 80, the base or upper end of cylinder 79 being pivoted to the mounting plate 75. The leading end of the pivotal clamp 77′ is formed with a horizontal portion 77′*a* (FIG. 6). The pivotal clamp 77′ is normally urged in the counterclockwise direction as shown by the arrow 81 in FIG. 6 so as to press the horizontal portion 77′*a* against the flat surface of the table with a moderate force to maintain the horizontal portion in the position as shown in FIG. 6. In such position of the horizontal portion 77′*a* of the pivotal clamp 77′, it is apparent that a clearance is present between the stationary and pivotal clamps 77, 77′ for receiving the work 100 therein. With the parts maintained in the position as shown in FIG. 6, when the piston rod 79*a* is extended out of the cylinder 79 against the force of the return spring within the cylinder, the pivotal clamp 77′ pivots about the pivot pin 78 in the clockwise direction shown by the arrow 82 in FIG. 6 to firmly grip the work 100 in cooperation with the upper stationary clamp 77. The undersurface of the stationary clamp 77 may be provided with a friction plate 83 so that the work can be more positively gripped between the clamps 77, 77′.

The upper surface of the stationary clamp 77 is provided with a detection means 90 which comprises a luminous diode and a phototransistor (not shown) provided on the upper surface of the stationary clamp 77. The output light from the luminous diode is directed through an aperture in the stationary clamp 77 onto the pivotal clamp 77′ which in turn reflects the light onto the phototransistor. For this purpose, it is preferable that at least an area of the movable clamp 77′ where the light is received is mirror-finished. The detection means 90 functions to electrically detect the presence of the work 100 or not between the stationary and pivotal clamps 77, 77′.

Now referring to FIG. 4, the gear 73 is engaged by an intermediate gear 91 which is in turn in engagement with a gear 93 fixedly secured to the drive shaft of a motor 92. Thus, when the motor 92 is energized, the energized motor 92 rotates the shaft 72 and accordingly, the rocker arm 74 through the gear 93, intermediate gear 91 and gear 73. The motor 92 is fixedly secured to the housing 71. As will be more particularly described hereinafter, the rocker arm 74 is set to terminate its rotation when the detection means 90 detects the presence of the work or when the work is present between the stationary and pivotal clamps 77, 77′ and the output light from the luminous diode is interrupted.

A cam 111 is secured to an upper portion of the rotary shaft 72 and a limit switch 113 is provided with a contact 113*a* positioned in opposition to the cam 111 (FIG. 5).

Assuming that the rocker arm 74 is in its waiting position as shown by the broken line, the rocker arm 74 initiates its rotation following the movement of the work just before the sewing operation at a particular or first edge of the work is completed and the detection means 90 detects a second edge of the work to be next sewn. When the first work edge has been sewn to the predetermined terminal end of the first edge or the sewing at the edge has been completed, the cylinder 79 operates to extend the piston rod 79*a*. In consequence, the pivotal clamp 77′ pivots upwardly to grip the work in cooperation with the upper stationary clamp 77. Thereafter, the pressure bar raises and the rocker arm 74 rotates in the reverse direction to turn the work about the needle drop point 22 until the next work edge aligns with the sewing or work feed direction. The terminal point for the turning of the work is independent of the angular relationship between adjacent edges of the work, different from the prior art arrrangements, and is determined by pushing the contact 113*a* of the limit switch 113 by the cam 111 so as to terminate the turning of the work. Thereafter, the cylinder 79 is rendered inoperative to retract the piston rod into the cylinder and the work is released from between the stationary and pivotal clamps 77, 77′. By the provision of the turning means, after the sewing operation has been completed for a particular edge of the work, the work can be gripped at an area in the vicinity of the next work edge contiguous to the particular edge without developing a crease or creases in the work.

The entire operation of the automatic sewing machine of the present invention is controlled by a control board 160 mounted on the framework 10 (FIG. 1).

The operation of the automatic sewing machine of the invention will now be described in connection with the sewing of the edges of the fabric pieces for a pair of trousers. FIG. 7 shows the fabric piece for the body of one of a pair of trousers by reference numeral I, and FIG. 8 shows the fabric piece for the body of the other of the pair of trousers by reference numeral II. The fabric piece I is sewn in the sewing sequence A, B, C and D as shown in FIG. 7, whereas the fabric piece II is sewn in the sewing sequence A, B, C and D as shown in FIG. 8.

In operation, first of all, the work is inserted into the sewing machine to a predetermined sewing position by the operator, and when all the detection means detect the presence of the work in the predetermined sewing position, the sewing operation on the sewing machine starts. While the sewing machine is sewing a particular or first edge of the work, the detection means detects the work edge to drive the manipulator which in turn corrects any deviation in the position of the work edge if any. Thus, the work is fed to a proper position below the sewing needle depending upon a particular cut configuration of the work to thereby eliminate the wasteful removal of any portion of the work by the trimming cutter which makes the work unshapely. As the sewing proceeds from Point A to Point B and the work clears the detection means 50, the sewing machine achieves the so-called "no work present" condition, whereupon the main motor 11 reduces its rotation speed preparatory for stoppage, and the work advances at the reduced speed of the main motor 11. When the work clears the detection 60, the detection 60 detects the passage of the work thereby. After a predetermined time period has passed, the work stops its movement at the needled drop point leaving a width for hemstitching with the sewing needle maintained at its lower dead point. The predetermined time after the work has passed by the detection means 60 is determined only by the work feed pitch, because the number of rotations at the reduced speed of the main motor preparatory for stoppage is constant and previously set. At this time, the turning means operates to detect the next edge extending from Point B to Point C of the work to be sewn, grips the work and turns the work so as to position the next work edge to a predetermined position or a position in which the next work edge aligns with the work feed direction. During the turning of the work, the pressure bar and the manipulator, which are raised to the upper position at the time of the passage of the work by the detection means 60, move downwardly to hold the work down. Thereafter, the sewing operation resumes and the work edge extending from Point B to Point C is sewn. In this way, the sewing then proceeds along the work edge extending from Point B to Point C, then the work edge extending from Point C to Point D, and then the work edge extending from Point D to Point E. The thread is cut off the work at Point E from where the product is stacked by a stacker suitably selected for the particular configuration of the work.

Thus, the entire sewing sequence for each of the fabric pieces I and II will be as follows:

A → B, turn, B → C, turn, C → D, turn, D → E, thread cutting and stacking.

While the invention has been described in conjunction with a specific embodiment, it is to be understood that many alternatives, modifications, and variations will be apparent to those skilled in the art in light of the foregoing description. Accordingly, it is intended that all such alternatives, modifications, and variations fall within the spirit and scope of the appended claims:

What is claimed is:

1. An automatic sewing machine comprising: sewing means for successively sewing edges of a workpiece extending in angular relationship to each other;

work advancing means for advancing the workpiece in a work advancing direction toward said sewing means;

guide means for continuously aligning a given edge of the workpiece being sewn during a sewing operation with said work advancing direction; and turning means for turning said workpiece to align the next successive edge thereof contiguous to said given edge with said work advancing direction, so that said next successive edge may be sewn after said given edge, said turning means comprising:

a rotatable member rotatable about a fixed point in a first direction from a predetermined initial position toward said next successive edge of said workpiece;

clamp means supported by said rotatable member and rotatable therewith for clamping opposite sides of said next successive edge of said workpiece;

detection means for detecting when said clamp means has been moved by said rotatable member to a position such that said next successive edge of said workpiece may be clamped by said clamp means and for then stopping the rotation of said rotatable member in said first direction, thereby maintaining a relative positional relationship between said clamp means and said next successive edge of said workpiece; and means for causing said rotatable member to rotate in a second direction opposite to said first direction, after said clamp means has clamped said opposite sides of said next successive edge of said workpiece, and for returning said rotatable member to said predetermined initial position, thereby turning said workpiece about the sewing point of said sewing means until said next successive edge of said workpiece is aligned with said work advancing direction.

2. An automatic sewing machine as claimed in claim 1, wherein said clamp means comprises an upper substantially horizontally positioned stationary clamp, a movable clamp having a first end mounted about a pivot on said stationary clamp and a second end disposed to slidably contact a table of said sewing machine when in a non-clamping position, and drive means for moving said movable clamp from said non-clamping position about said pivot toward said stationary clamp to thereby clamp therebetween said next successive edge of said workpiece.

3. An automatic sewing machine as claimed in claim 2, wherein said stationary clamp has formed in the surface thereof facing said movable clamp a friction plate.

4. An automatic sewing machine as claimed in claim 2, wherein said drive means comprises an air cylinder.

5. An automatic sewing machine as claimed in claim 1, wherein said detection means is mounted on said clamp means.

6. An automatic sewing machine as claimed in claim 1, wherein said rotatable member is rotated in said first direction before the completion of the sewing of said given edge.

7. An automatic sewing machine as claimed in claim 6, wherein said returning means includes a limit switch for detecting that said rotatable member is operatively restored to said predetermined initial position and for then controlling release of said clamp means from said next successive edge of said workpiece and the initiation of sewing of said next successive edge of said workpiece.

* * * * *